US011685150B2

(12) United States Patent
Praharaj et al.

(10) Patent No.: US 11,685,150 B2
(45) Date of Patent: Jun. 27, 2023

(54) METHOD AND APPARATUS FOR IN-SITU DIGITAL IMAGE FORMING FOUNTAIN SOLUTION THICKNESS MEASUREMENT

(71) Applicant: Xerox Corporation, Norwalk, CT (US)

(72) Inventors: Seemit Praharaj, Webster, NY (US); Chu-heng Liu, Penfield, NY (US); Paul J. McConville, Webster, NY (US); Douglas K. Herrmann, Webster, NY (US); Jason M. Lefevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 29 days.

(21) Appl. No.: 17/358,634

(22) Filed: Jun. 25, 2021

(65) Prior Publication Data

US 2022/0410560 A1 Dec. 29, 2022

(51) Int. Cl.
*B41F 31/02* (2006.01)
*B41F 31/13* (2006.01)

(52) U.S. Cl.
CPC ..... *B41F 31/022* (2013.01); *B41F 31/13* (2013.01)

(58) Field of Classification Search
CPC .... B41F 33/0063; B41F 31/022; B41F 31/13; B41P 2227/70; G01N 19/02
See application file for complete search history.

(56) References Cited

U.S. PATENT DOCUMENTS 10,336,057 B2 * 7/2019 Moore ..... B41F 7/00
2012/0103212 A1 5/2012 Stowe et al.
2012/0103221 A1 5/2012 Stowe et al.

OTHER PUBLICATIONS

Co-Pending U.S. Appl. No. 17/137,473, filed Dec. 30, 2020.
Co-Pending U.S. Appl. No. 16/916,907, filed Jun. 30, 2020.
Co-ending U.S. Appl. No. 16/917,044, filed Jun. 30, 2020.
Co-Pending U.S. Appl. No. 17/137,516, filed Dec. 30, 2020.
Co-Pending U.S. Appl. No. 16/913,302, filed Jun. 26, 2020.
Co-Pending U.S. Appl. No. 17/137,711, filed Dec. 30, 2020.
Co-Pending U.S. Appl. No. 16/913,351, filed Jun. 26, 2020.
Co-Pending U.S. Appl. No. 17/137,626, filed Dec. 30, 2020.
Co-Pending U.S. Appl. No. 16/913,626, filed Jun. 26, 2020.
Co-Pending U.S. Appl. No. 17/149,161, filed Jan. 14, 2021.
Co-Pending U.S. Appl. No. 17/161,879, filed Jan. 29, 2021.
Co-Pending U.S. Appl. No. 17/177,262, filed Feb. 17, 2021.
Co-Pending U.S. Appl. No. 17/336,729, filed Jun. 2, 2021.
Co-Pending U.S. Appl. No. 17/345,643, filed Jun. 11, 2021.
Co-Pending U.S. Appl. No. 17/355,692, filed Jun. 23, 2021.

* cited by examiner

*Primary Examiner* — Matthew G Marini
*Assistant Examiner* — Leo T Hinze
(74) *Attorney, Agent, or Firm* — Caesar Rivise, PC

(57) ABSTRACT

A coefficient of friction (COF) sensor on a carrier roll surface wetted with fountain solution transferred from an imaging member measures COF of the wetted carrier roll surface in real-time, even between or during printing operations. The transferred fountain solution may be concentrated and/or chilled to solidify before the measurement. The measured COF is used in a feedback loop to actively control the fountain solution layer thickness by adjusting the volumetric feed rate of fountain solution added onto the imaging member surface during an imaging or other printing operation to reach a desired uniform thickness for the printing. This fountain solution monitoring system may be fully automated.

20 Claims, 11 Drawing Sheets

METHOD AND APPARATUS FOR IN-SITU DIGITAL IMAGE FORMING FOUNTAIN SOLUTION THICKNESS MEASUREMENT

FIELD OF DISCLOSURE

This invention relates generally to digital image forming systems, and more particularly, to fountain solution deposition systems and methods for use in lithographic offset printing systems.

BACKGROUND

Conventional lithographic printing techniques cannot accommodate true high speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system, or a digital advanced lithography imaging system. A "variable data lithography system" is a system that is configured for lithographic printing using lithographic inks and based on digital image data, which may be variable from one image to the next. "Variable data lithography printing," or "digital ink-based printing," or "digital offset printing," or digital advanced lithography imaging is lithographic printing of variable image data for producing images on a substrate that are changeable with each subsequent rendering of an image on the substrate in an image forming process.

For example, a digital offset printing process may include transferring ink onto a portion of an imaging member (e.g., fluorosilicone-containing imaging member, printing plate) having a surface or imaging blanket that has been selectively coated with a fountain solution (e.g., dampening fluid) layer according to variable image data. According to a lithographic technique, referred to as variable data lithography, a non-patterned reimageable surface of the imaging member is initially uniformly coated with the fountain solution layer. An imaging system then evaporates regions of the fountain solution layer in an image area by exposure to a focused radiation source (e.g., a laser light source, high power laser) to form pockets. A temporary pattern latent image in the fountain solution is thereby formed on the surface of the digital offset imaging member. The latent image corresponds to a pattern of the applied fountain solution that is left over after evaporation. Ink applied thereover is retained in the pockets where the laser has vaporized the fountain solution. Conversely, ink is rejected by the plate regions where fountain solution remains. The inked surface is then brought into contact with a substrate at a transfer nip and the ink transfers from the pockets in the fountain solution layer to the substrate. The fountain solution may then be removed, a new uniform layer of fountain solution applied to the printing plate, and the process repeated.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

The inventors have found that digital printing processes are sensitive to the amount of fountain solution applied to the imaging member blanket. If too much fountain solution is applied to the imaging member surface, then the laser may not be able to boil/evaporate the fountain solution and no image will be created on the blanket. If too little fountain solution is applied to the imaging member surface, then the ink will not be rejected in the non-imaged regions leading to high background. Currently, there is no way to measure how much fountain solution is deposited on the imaging member blanket in real-time during a printing operation. Further, current fountain solution systems manually operate open loop, where the amount of fountain solution is manually adjustable based on image quality of previous print jobs. In this state, fountain solution systems are at the mercy of printing device noises and may require constant manual adjustments.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a method of controlling fountain solution thickness on an imaging member surface of a rotating imaging member in a digital image forming device. The method includes: (a) transferring fountain solution from a fountain solution layer dispensed onto the rotating imaging member at a dispense rate onto a carrier roll having a surface with a coefficient of friction (COF) that varies as a function of fountain solution layer thickness to allow the transferred fountain solution to wet the carrier roll surface and alter the COF to a wetted COF, (b) measuring the wetted COF of the wetted carrier roll surface, (c) modifying the fountain solution dispense rate based on the measured COF, and (d) applying a subsequent fountain solution layer at the modified fountain solution dispense rate onto the imaging member surface for an image forming operation thereon.

According to aspects illustrated herein, an exemplary method of controlling fountain solution thickness on an imaging member surface of a rotating imaging member in a digital image forming device, with the digital image forming device printing a current image onto a print substrate. The printing may include applying a fountain solution layer at a dispense rate onto the imaging member surface with the fountain solution fluid layer having a surface above the imaging member surface, vaporizing in an image wise fashion a portion of the fountain solution layer to form a latent image, applying ink onto the latent image over the imaging member surface, and transferring the applied ink from the imaging member surface to the print substrate. The method of controlling fountain solution thickness includes: (a) transferring fountain solution from a fountain solution layer dispensed onto the rotating imaging member at a dispense rate onto a carrier roll having a surface with a COF that varies as a function of fountain solution layer thickness to allow the transferred fountain solution to wet the carrier roll surface and alter the COF to a wetted COF, (b) measuring the COF of the wetted carrier roll surface, and (c) modifying the fountain solution dispense rate based on the measured COF for a subsequent printing of a subsequent image by the image forming device using the modified fountain solution dispense rate.

In examples, after measuring the coefficient of friction (COF) of the wetted carrier roll surface, the methods may include comparing the measured COF to a target COF and/or estimating a thickness of the dispensed fountain solution fluid layer based on the measured COF and then comparing the estimated thickness of the dispensed fountain solution fluid layer with a target thickness. In such examples the step of modifying the fountain solution dispense rate based on the measured COF may include modifying the fountain solution dispense rate based on the comparison between the measured COF and the target COF, modifying the fountain solution dispense rate based on the thickness of the re-condensed fountain solution layer, modifying the fountain solution dispense rate based on the estimated thickness of the dispensed fountain solution layer, and/or modifying the fountain solution dispense rate based on the comparison between the estimated thickness of the deposited fountain solution layer and the target thickness.

According to aspects described herein, an exemplary digital image forming device controls fountain solution thickness on an imaging member surface of a rotating imaging member. The digital image forming device may include a carrier roll, a heat source, a sensor, and a controller. The carrier roll has a surface with a COF that varies as a function of fountain solution layer thickness. The heat source is specifically designed to evaporate fountain solution from a fountain solution layer dispensed onto the rotating imaging member at a dispense rate for transfer onto the carrier roll. The transferred fountain solution wets the carrier roll surface via condensation thereon and alters the COF to a wetted COF. The sensor has a sensor head adjacent the fountain solution carrier roller and in contact with the transferred fountain solution, with the sensor specifically designed to measure the wetted COF. The controller is in communication with the sensor and the fountain solution applicator to modify the fountain solution dispense rate based on the measured wetted COF for a subsequent dispense of a subsequent fountain solution layer at the modified fountain solution dispense rate onto the imaging member surface for an image forming operation thereon.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
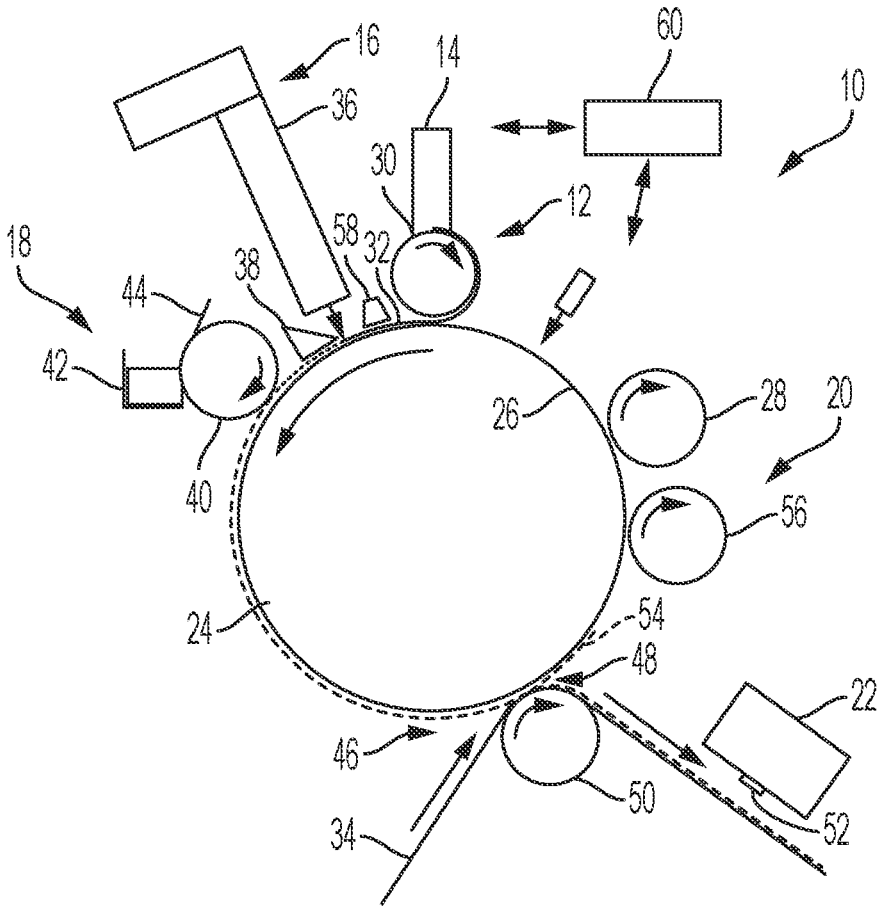
FIG. 1 is a block diagram of a digital image forming device in accordance with examples of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

Although embodiments of the invention are not limited in this regard, discussions utilizing terms such as, for example, "processing," "computing," "calculating," "determining," "using," "establishing", "analyzing", "checking", or the like, may refer to operation(s) and/or process(es) of a controller, computer, computing platform, computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may include D4 or D5 dampening fluid alone, mixed, and/or with wetting agents. The fountain solution may also include Isopar G, Isopar H, Dowsil OS10, Dowsil OS20, Dowsil OS30, and mixtures thereof.

Inking systems or devices may be incorporated into digital offset image forming device architecture so that the inking system is arranged about a central imaging plate, also referred to as an imaging member. In such a system, the imaging member is a rotatable imaging member, including a conformable blanket around a cylindrical drum with the conformable blanket including the reimageable surface. This blanket layer has specific properties such as composition, surface profile, and so on so as to be well suited for receipt and carrying a layer of a fountain solution. A surface of the imaging member is reimageable making the imaging member a digital imaging member. The surface is constructed of elastomeric materials and conformable. A paper path architecture may be situated adjacent the imaging member to form a media transfer nip.

A layer of fountain solution may be applied to the surface of the imaging member by a dampening system. In a digital evaporation step, particular portions of the fountain solution layer deposited onto the surface of the imaging member may be evaporated by a digital evaporation system. For example, portions of the fountain solution layer may be vaporized by an optical patterning subsystem such as a scanned, modulated laser that patterns the fluid solution layer to form a latent image. In a vapor removal step, the vaporized fountain solution may be collected by a vapor removal device or vacuum to prevent condensation of the vaporized fountain solution back onto the imaging plate.

In an inking step, ink may be transferred from an inking system to the surface of the imaging member such that the ink selectively resides in evaporated voids formed by the patterning subsystem in the fountain solution layer to form an inked image. In an image transfer step, the inked image is then transferred to a print substrate such as paper via pressure at the media transfer nip.

In a digital variable printing process, previously imaged ink must be removed from the imaging member surface to prevent ghosting. After an image transfer step, the surface of the imaging member may be cleaned by a cleaning system so that the printing process may be repeated. For example, tacky cleaning rollers may be used to remove residual ink and fountain solution from the surface of the imaging member.

A drawback of digital print processes is print quality sensitivity to the amount of fountain solution deposited onto the imaging blanket. It is estimated that a very thin layer of fountain solution (e.g., 30-100 nm thickness range) is required on the blanket for optimal print process setup. This makes measuring the fountain solution thickness on the imaging blanket most difficult.

FIG. 1 depicts an exemplary ink-based digital image forming device 10. The image forming device 10 may include dampening station 12 having fountain solution applicator 14, optical patterning subsystem 16, inking apparatus 18, and a cleaning device 20. The image forming device 10 may also include one or more rheological conditioning subsystems 22 as discussed, for example, in greater detail below. FIG. 1 shows the fountain solution applicator 14 arranged with a digital imaging member 24 having a reimageable surface 26. While FIG. 1 shows components that are formed as rollers, other suitable forms and shapes may be implemented.

The imaging member surface 26 may be wear resistant and flexible. The surface 26 may be reimageable and conformable, having an elasticity and durometer, and sufficient flexibility for coating ink over a variety of different media types having different levels of roughness. A thickness of the reimageable surface layer may be, for example, about 0.5 millimeters to about 4 millimeters. The surface 26 should have a weak adhesion force to ink, yet good oleophilic wetting properties with the ink for promoting uniform inking of the reimageable surface and subsequent transfer lift of the ink onto a print substrate.

The soft, conformable surface 26 of the imaging member 24 may include, for example, hydrophobic polymers such as silicones, partially or fully fluorinated fluorosilicones and FKM fluoroelastomers. Other materials may be employed, including blends of polyurethanes, fluorocarbons, polymer catalysts, platinum catalyst, hydrosilyation catalyst, etc. The surface may be configured to conform to a print substrate on which an ink image is printed. To provide effective wetting of fountain solutions such as water-based dampening fluid, the silicone surface need not be hydrophilic, but may be hydrophobic. Wetting surfactants, such as silicone glycol copolymers, may be added to the fountain solution to allow the fountain solution to wet the reimageable surface 26. The imaging member 24 may include conformable reimageable surface 26 of a blanket or belt wrapped around a roll or drum. The imaging member surface 26 may be temperature controlled to aid in a printing operation. For example, the imaging member 24 may be cooled internally (e.g., with chilled fluid) or externally (e.g., via a blanket chiller roll to a temperature (e.g., about 10° C.-60° C.) that may aid in the image forming, transfer and cleaning operations of image forming device 10.

The reimageable surface 26 or any of the underlying layers of the reimageable belt/blanket may incorporate a radiation sensitive filler material that can absorb laser energy or other highly directed energy in an efficient manner. Examples of suitable radiation sensitive materials are, for example, microscopic (e.g., average particle size less than 10 micrometers) to nanometer sized (e.g., average particle size less than 1000 nanometers) carbon black particles, carbon black in the form of nano-particles of, single or multi-wall nanotubes, graphene, iron oxide nano-particles, nickel plated nano-particles, etc., added to the polymer in at least the near-surface region. It is also possible that no filler material is needed if the wavelength of a laser is chosen so to match an absorption peak of the molecules contained within the fountain solution or the molecular chemistry of the outer surface layer. As an example, a 2.94 μm wavelength laser would be readily absorbed due to the intrinsic absorption peak of water molecules at this wavelength.

The imaging member surface 26 may be temperature controlled to aid in a printing operation. For example, the imaging member 24 may be cooled internally (e.g., with chilled fluid via a central drum chiller 62 refrigerant line that cools the imaging member drum) or externally (e.g., via a blanket chiller roll 28) to a temperature (e.g., about 10° C.-60° C.) that may aid in the image forming, transfer and cleaning operations of image forming device 10. The imaging member may be cooled according to a temperature setpoint of the drum chilling system including the central drum chiller 62 and/or blanket chiller roll 28. The temperature setpoint may be predetermined (e.g., about 0° C.-60° C.) or adjusted within a predetermined range as readily understood by a skilled artisan.

The central drum chiller 62 may include a housing (e.g., roller, duct) in contact with the inner wall of the imaging member drum. The chiller is not limited to the size of the cylindrical housing shown in FIG. 1, and may expand to even include the inner wall of the imaging member drum. In other words, an exemplary central drum chiller 62 may expand to the imaging member drum, which may then define the cylindrical housing of the chiller. The central drum chiller 62 provides internal chilling or temperature control to the imaging member drum via fluid circulated through the interior of the hollow chiller. The drum chilling system may pump and recirculate the fluid into and out of the chiller 62. The drum chilling system may also include a refrigeration system heat exchanger, and even a heating system to remove or add heat, respectively, from the re-circulating fluid depending on the current fluid temperature and the temperature setpoint of the drum chilling system. Heat absorbed by the fluid while in contact with the inner surface of the hollow chiller 62 and the imaging member drum may be removed by the drum chilling system. In examples where the imaging member drum inner wall includes the cylindrical chiller housing, chilled fluid internal to the hollow drum enables a longer dwell time to remove heat, since the chilled fluid may fill the inside of the drum and maximize a heat exchange contact area.

The fountain solution applicator 14 may be configured to deposit a layer of fountain solution at a dispense rate onto the imaging member surface 26 and form a fountain solution layer 32 thereon directly or via an intermediate member (e.g., roller 30) of the dampening station 12. While not being limited to particular configuration, the fountain solution applicator 14 may include a series of rollers, sprays or a vaporizer (not shown) for uniformly wetting the reimageable surface 26 with a uniform layer of fountain solution with the thickness of the layer being controlled. The series of rollers may be considered as dampening rollers or a dampening unit, for uniformly wetting the reimageable surface 26 with a layer of fountain solution. The fountain solution may be applied by fluid or vapor deposition to create the thin fluid fountain solution layer 32 (e.g., between about 0.01 μm and about 1.0 μm in thickness, less than 5 μm, about 30 nm to 70 nm) of the fountain solution for uniform wetting and pinning. The applicator 14 may include a slot at its output across the imaging member 26 or intermediate roller 30 to output fountain solution to the imaging member surface 26.

Figure 2:
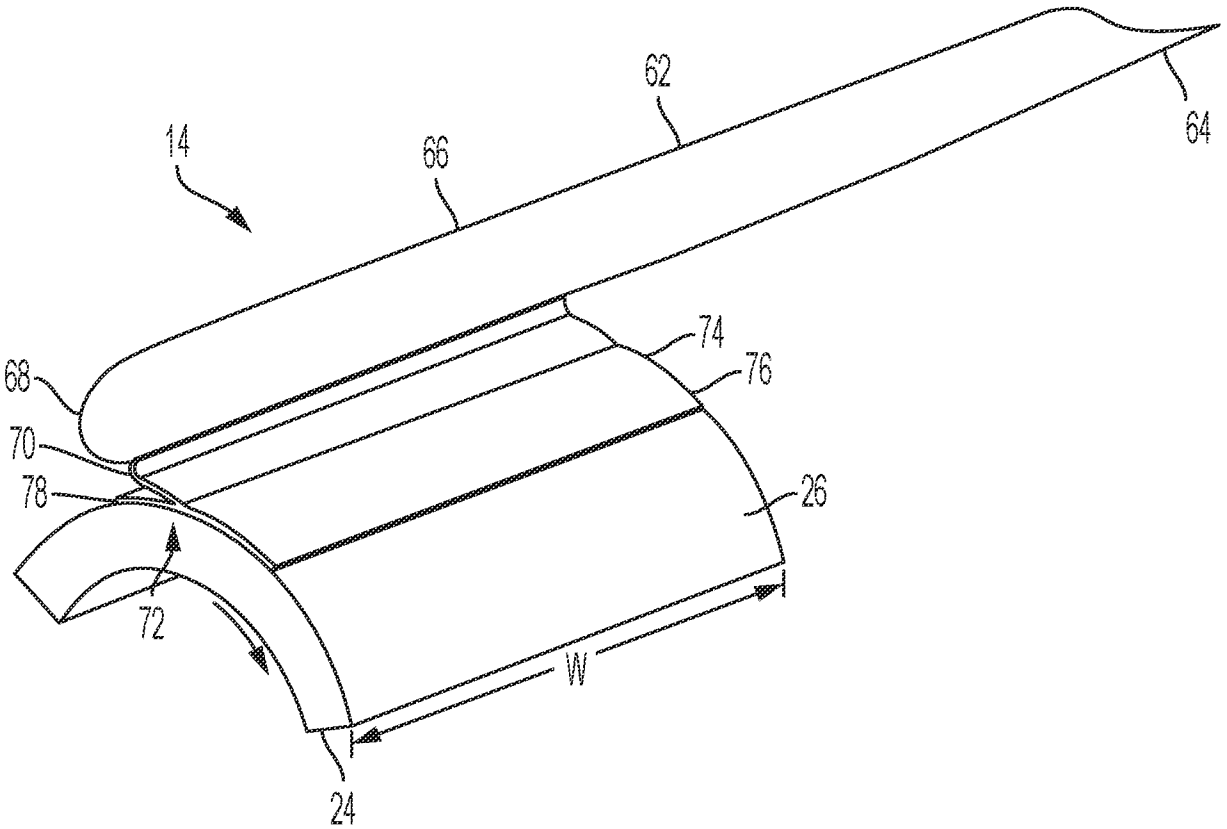
FIG. 2 is a perspective view of an exemplary fountain solution applicator.

FIG. 2 depicts another exemplary fountain solution applicator 14 that may apply a fountain solution layer directly onto the imaging member surface 26. The fountain solution applicator 14 includes a supply chamber 62 that may be generally cylindrical defining an interior for containing fountain solution vapor therein. The supply chamber 62 includes an inlet tube 64 in fluid communication with a fountain solution supply (not shown), and a tube portion 66 extending to a closed distal end 68 thereof. A supply channel 70 extends from the supply chamber 62 to adjacent the imaging member surface 26, with the supply channel defining an interior in communication with the interior of the supply chamber to enable flow of fountain solution vapor from the supply chamber through the supply channel and out a supply channel outlet slot 72 for deposition over the imaging member surface, where the fountain solution vapor condenses to a fluid on the imaging member surface.

A vapor flow restriction border 74 extends from the supply channel 70 adjacent the reimageable surface 26 to confine fountain solution vapor provided from the supply channel outlet slot 72 to a condensation region defined by the restriction border and the adjacent reimageable surface to support forming a layer of fountain solution on the reimageable surface via condensation of the fountain solution vapor onto the reimageable surface. The restriction border 74 defines the condensation region over the surface 26 of the imaging member 24. The restriction border includes arc walls 76 that face the imaging member surface 26, and border wall 78 that extends from the arc walls towards the imaging member surface. The reimageable surface 26 of the imaging member 24 may have a width W parallel to the supply channel 70 and supply channel outlet slot 72, with the outlet slot having a width across the imaging member configured to enable fountain solution vapor in the supply chamber interior to communicate with the imaging member surface across its width. In examples where the fountain solution applicator 14 deposits fountain solution vapor onto the imaging member surface 26 that condenses to form the fountain solution layer 32, excess vapor may be collected and removed after sufficient condensation, for example, via a vacuum or other vapor removal device (not shown) to prevent condensation of the vaporized fountain solution back onto the imaging plate.

Referring back to FIG. 1 the optical patterning subsystem 16 is located downstream the fountain solution applicator 14 and the drag force meter 58 in the printing processing direction to selectively pattern a latent image in the layer of fountain solution by image-wise patterning using, for example, laser energy. In examples, the fountain solution layer is exposed to an energy source (e.g. a laser) that selectively applies energy to portions of the layer to image-wise evaporate the fountain solution and create a latent "negative" of the ink image that is desired to be printed on a receiving substrate 34. Image areas are created where ink is desired, and non-image areas are created where the fountain solution remains. While the optical patterning subsystem 16 is shown as including laser emitter 36, it should be understood that a variety of different systems may be used to deliver the optical energy to pattern the fountain solution layer.

A vapor vacuum 38 or air knife may be positioned downstream the optical patterning subsystem to collect vaporized fountain solution and thus avoid leakage of excess fountain solution into the environment. Reclaiming excess vapor prevents fountain solution from depositing uncontrollably prior to the inking apparatus 18 and imaging member 24 interface. The vapor vacuum 38 may also prevent fountain solution vapor from entering the environment. Reclaimed fountain solution vapor can be condensed, filtered and reused as understood by a skilled artisan to help minimize the overall use of fountain solution by the image forming device 10.

Following patterning of the fountain solution layer by the optical patterning subsystem 16, the patterned layer over the reimageable surface 26 is presented to the inking apparatus 18. The inker apparatus 18 is positioned downstream the optical patterning subsystem 16 to apply a uniform layer of ink over the layer of fountain solution and the reimageable surface layer 26 of the imaging member 24. The inking apparatus 18 may deposit the ink to the evaporated pattern representing the imaged portions of the reimageable surface 26, while ink deposited on the unformatted portions of the fountain solution will not adhere based on a hydrophobic and/or oleophobic nature of those portions. The inking apparatus may heat the ink before it is applied to the surface 26 to lower the viscosity of the ink for better spreading into imaged portion pockets of the reimageable surface. For example, one or more rollers 40 of the inking apparatus 18 may be heated, as well understood by a skilled artisan. Inking roller 40 is understood to have a structure for depositing marking material onto the reimageable surface layer 26, and may include an anilox roller or an ink nozzle. Excess ink may be metered from the inking roller 40 back to an ink container 42 of the inker apparatus 18 via a metering member 44 (e.g., doctor blade, air knife).

Although the marking material may be an ink, such as a UV-curable ink, the disclosed embodiments are not intended to be limited to such a construct. The ink may be a UV-curable ink or another ink that hardens when exposed to UV radiation. The ink may be another ink having a cohesive bond that increases, for example, by increasing its viscosity. For example, the ink may be a solvent ink or aqueous ink that thickens when cooled and thins when heated.

Downstream the inking apparatus 18 in the printing process direction resides ink image transfer station 46 that transfers the ink image from the imaging member surface 26 to a print substrate 34. The transfer occurs as the substrate 34 is passed through a transfer nip 48 between the imaging member 24 and an impression roller 50 such that the ink within the imaged portion pockets of the reimageable surface 26 is brought into physical contact with the substrate 34 and transfers via pressure at the transfer nip from the imaging member surface to the substrate as a print of the image.

Rheological conditioning subsystems 22 may be used to increase the viscosity of the ink at specific locations of the digital offset image forming device 10 as desired. While not being limited to a particular theory, rheological conditioning subsystem 22 may include a curing mechanism 52, such as a UV curing lamp (e.g., standard laser, UV laser, high powered UV LED light source), wavelength tunable photoinitiator, or other UV source, that exposes the ink to an amount of UV light (e.g., # of photons radiation) to at least partially cure the ink/coating to a tacky or solid state. The curing mechanism may include various forms of optical or photo curing, thermal curing, electron beam curing, drying, or chemical curing. In the exemplary image forming device 10 depicted in FIG. 1, rheological conditioning subsystem 22 may be positioned adjacent the substrate 34 downstream the ink image transfer station 46 to cure the ink image transferred to the substrate. Rheological conditioning subsystems 22 may also be positioned adjacent the imaging member surface 26 between the ink image transfer station 46 and cleaning device 20 as a preconditioner to harden any residual ink 54 for easier removal from the imaging member surface 26 that prepares the surface to repeat the digital image forming operation.

This residual ink removal is most preferably undertaken without scraping or wearing the imageable surface of the imaging member. Removal of such remaining fluid residue may be accomplished through use of some form of cleaning device 20 adjacent the surface 26 between the ink image transfer station 46 and the fountain solution applicator 14. Such a cleaning device 20 may include at least a first cleaning member 56 such as a sticky or tacky roller in physical contact with the imaging member surface 26, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste. It is understood that the cleaning device 20 is one of numerous types of cleaning devices and that other cleaning devices designed to remove residual ink/fountain solution from the surface of imaging member 24 are considered within the scope of the embodiments. For example, the cleaning device could include at least one roller, brush, web, belt, tacky roller, buffing wheel, etc., as well understood by a skilled artisan.

Figure 6:
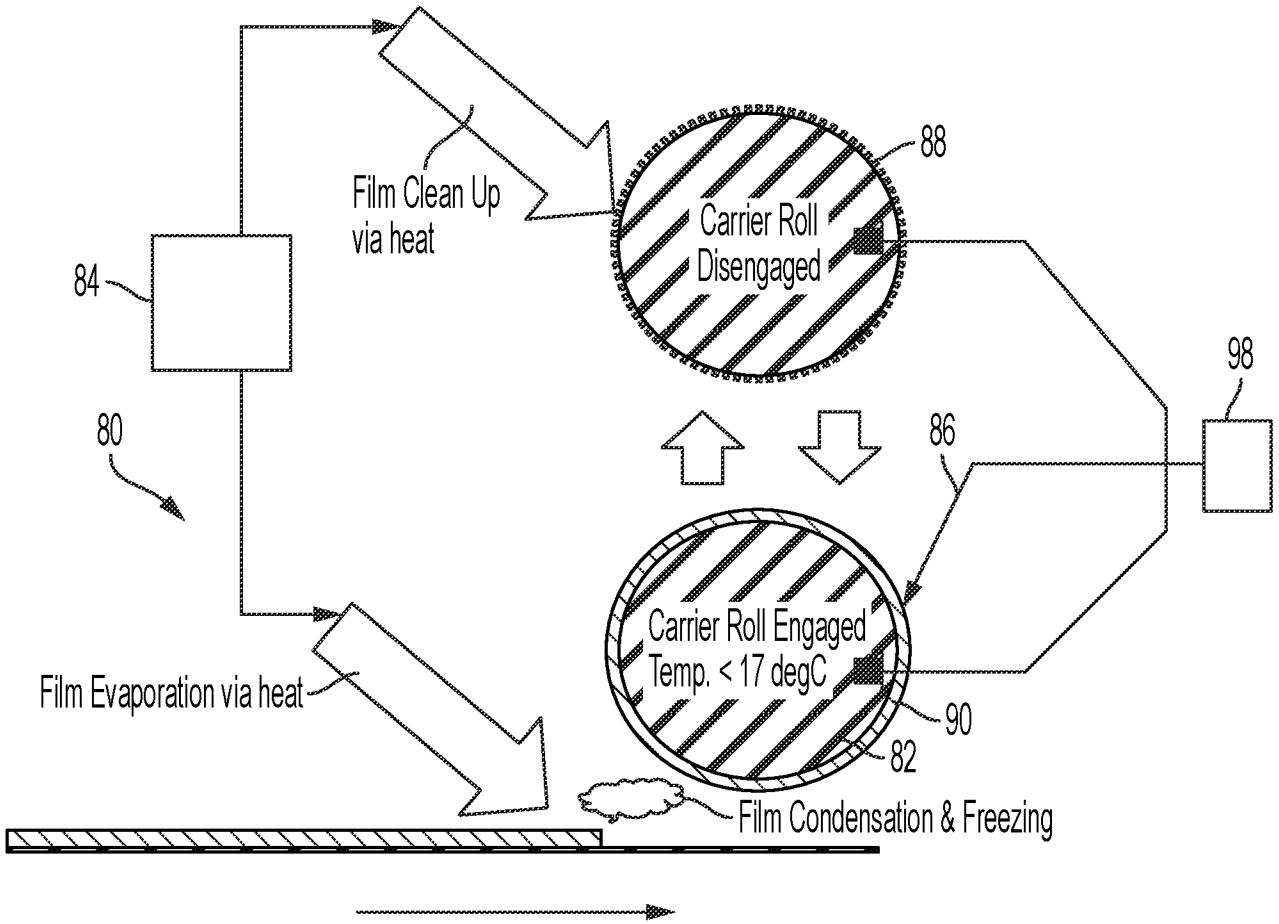
FIG. 6 is a block diagram of a carrier roll at engaged and disengaged positions in accordance with examples.

In the image forming device 10, functions and utility provided by the dampening station 12, optical patterning subsystem 16, inking apparatus 18, cleaning device 20, rheological conditioning subsystems 22, imaging member 24 and drag force meter 58 may be controlled, at least in part by controller 60. Such a controller 60 is shown in FIGS. 1 and 6, and may be further designed to receive information and instructions from a workstation or other image input devices (e.g., computers, smart phones, laptops, tablets, kiosk) to coordinate the image formation on the print substrate through the various subsystems such as the dampening station 12, patterning subsystem 16, inking apparatus 18, imaging member 24 and drag force meter 58 as discussed in greater detail herein and understood by a skilled artisan.

As noted above, currently there is no way to measure how much fountain solution is deposited on the imaging member blanket surface 26 in real-time automatically, between or during a printing operation. One drawback in trying to measure the thickness of fountain solution layer 32 directly on the imaging blanket is that the top surface of the blanket is coated with a fluorosilicone/carbon black solution. The carbon black is added to absorb the laser light during the imaging process. The carbon black also makes it very difficult to measure the fountain solution on the blanket during image forming operations using a non-contact specular sensor because light is absorbed by the blanket. An additional drawback of the fluorosilicone/carbon black imaging member surface is that contact sensors scuff/abrade the surface causing defects objectionable in the print or image. Another factor that makes film thickness sensing so challenging is the variability of the surface properties of the blanket. Surface properties such as topography, color, silicone oil presence, contaminations (ink, paper debris etc.) can change significantly from age, wear, and tear through the life of the blanket/imaging member reimageable surface 26. It is extremely challenging to measure the thickness of fountain solution directly on the DALI blanket, partly due at least to its un-controlled surface properties and also due to the challenging length scales associated with the measurement itself (e.g. less than 100 nm, between about 30 nm-70 nm, about 50 nm). This huge variability makes this thin film thickness measurement a daunting task.

Referring back to FIG. 1, the inventors found that using a measuring system 80 including a carrier roll 82 (FIG. 3), a heat source 84 (FIG. 3) and coefficient of friction (COF) sensor 86 (FIG. 3) can measure the thickness of fountain solution on the imaging member surface in real-time during or between printing operations. The location of this measuring system 80 is shown by example with a lead line arrow emanating from the measuring system. The measuring system 80 provides a low cost approach to determining fountain solution thickness on the imaging member surface indirectly by measuring COF of the carrier roll 82 adjacent the imaging member surface 26 wetted by fountain solution transferred from the imaging member 24, as can be seen by example in FIG. 3. While not being limited to a particular theory, the fountain solution carrier roll is adjacent the imaging member 24 to collect fountain solution transferred from the imaging member surface 26. The carrier roll has an engineered surface with a COF that varies as a function of fountain solution layer thickness, as will be discussed in greater detail below. Based on the measured COF of the wetted carrier roll surface, the dispense rate of fountain solution from the fountain solution applicator 14 may be modified by input from the controller 60 to arrive at a desired corresponding fountain solution layer 32 thickness on the imaging member 24.

Figure 3:
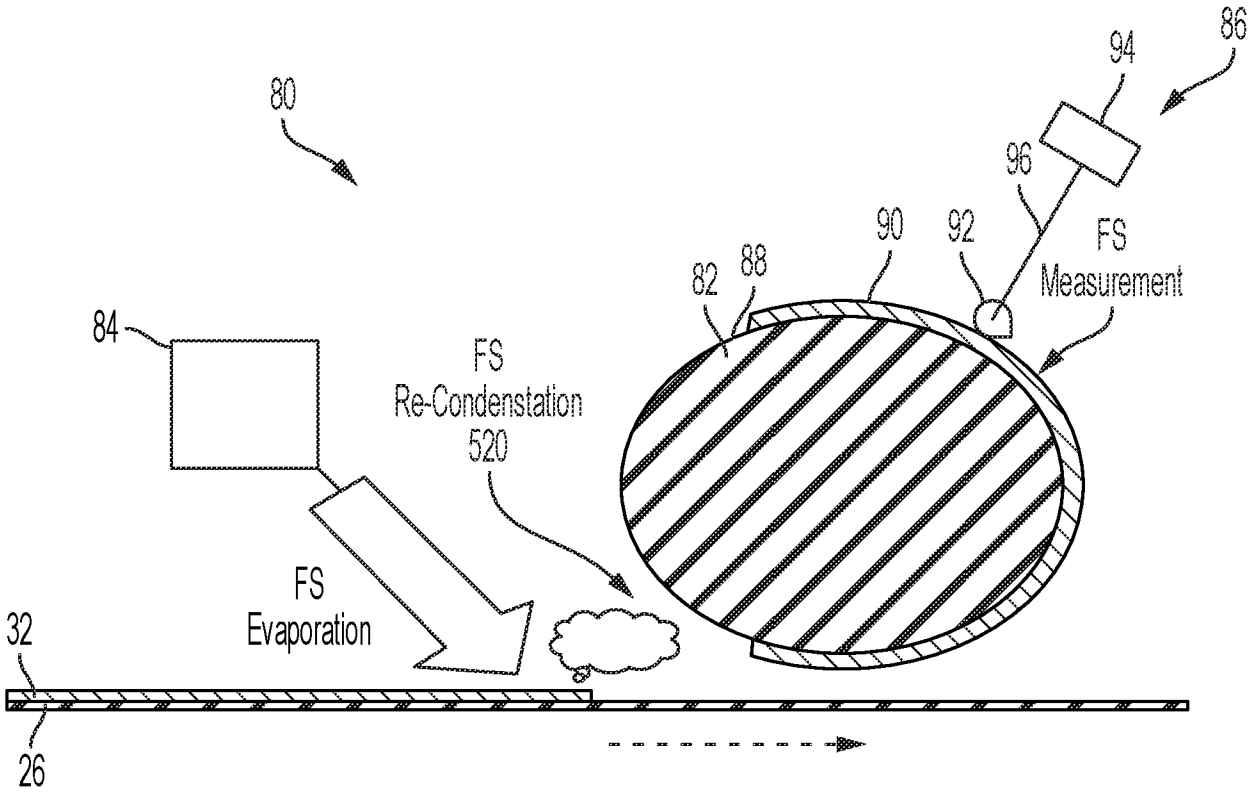
FIG. 3 is block diagram partially in section of an exemplary approach to transfer fountain solution from an imaging blanket surface to an engineered surface for measurement.

Although there are several ways to enable transfer of fountain solution from the imaging member surface 26 onto the carrier roll (e.g., direct fountain solution layer splitting contact transfer from the imaging member surface to the carrier roll, splitting fountain solution from an Inter-document zone or any other non-printing area of the blanket), FIG. 3 depicts one exemplary approach to transfer fountain solution from the imaging blanket surface 26 to a well-controlled substrate/surface for accurate measurement. In this example, the fountain solution layer 32 deposited onto the imaging member surface 26 by applicator 14 may be heated by heat source 84 (e.g., LED, LED bar, laser) and evaporated in close proximity of the carrier roll 82. While the carrier roll 82 can be seen as rotating with the rotational direction of the imaging member, it should be noted that the carrier roll can operate in either rotational direction. The carrier roll may be chilled or maintained at a temperature near or below the melting point of the fountain solution (e.g., less than about 17° C.-25° C. for silicone based fountain solutions). The vaporized fountain solution re-condenses on the surface 88 of the rotating carrier roll 82 with a re-condensed fountain solution layer 90 thickness proportional to the pre-vaporized fountain solution layer 32 thickness on the imaging member surface 26. Subsequent film thickness measurement can be performed on the carrier roll surface with the fountain solution in liquid or solid form.

Such an arrangement overcomes the variability of the surface properties of the blanket which is a factor that impacts film thickness sensing accuracy and viability. Additionally, the rotational speed of the carrier roll 82 can be significantly different from that of the original fountain solution carrier like imaging blanket 24. With variable speed and direction, the measuring system 80 provides the opportunity to concentrate/thicken the fountain solution on the carrier roll 82. During re-condensation of the vaporized fountain solution, the carrier roll 82 may rotate and have a surface speed slower than the surface speed of the imaging member surface 26 to concentrate/thicken the re-condensed fountain solution layer 90 thickness. For example, the carrier roll may be rotated with its surface 88 having a surface speed one-tenth the surface speed of the imaging member 24, such that the re-condensed fountain solution layer 90 thickness will be about ten times thicker (e.g., about 0.5 μm) than the thickness (e.g., about 50 nm) of the pre-vaporized fountain solution layer 32 on the imaging member surface 26. The fountain solution on the carrier roll 82 will then be much thicker for easier measurements. Of course, one could also run the carrier roll 82 faster to obtain a thinner film of fountain solution if desired. Being able to thicken and thin the film during transfer can greatly enhance the dynamic range of the measurement system.

FIG. 3 further illustrates an example of a sensor 58 in position to measure COF of the carrier roll surface 88. In examples the sensor 58 may include a sensor head 92 in contact with the carrier roll surface 88 having a fountain solution layer thereon on for measurement. The sensor head 94 shown in FIG. 3 may be in contact with the carrier roll surface 88 at any position across the width of the carrier roll 82. The sensor head 92 is not limited by shape, and may be spherical, cylindrical, ellipsoidal or other shapes sensitive to COF measurements of the carrier roll surface, as well understood by a skilled artisan. Scope is not limited by the approach of measuring the COF of the carrier roll surface by the sensor or tribometer, as there may be several ways as readily understood by a skilled artisan.

The sensor head 92 may attach to a sensor housing 94 directly or indirectly (e.g., via a coupling rod 96 having a COF gauge). The sensor 86 may also shift into and out of engagement with the fountain solution carrier roller as desired. For example, the sensor 86 may be attached to a displacement unit 98 (FIG. 6) including, for example, a servo motor for moving the sensor head 92 into engagement with the fountain solution carrier roll 82 to measure COF change caused by fountain solution on the carrier roll. The displacement unit 98 may move the sensor head 92 away from the carrier roll 82, for example when cleaning the carrier roll or when no measurement is needed to help minimize wear on the sensor head or the carrier roll.

The surface of the carrier roll 82 may be specially engineered to have a known surface roughness. For example, surface roughness that is easily achievable may be greater than 0.1 μm, greater than about 0.2 μm or about 0.3 μm to 0.6 μm. For reference, 400 grit sandpaper has a RMS surface roughness of about 0.25 μm. A higher surface roughness of the carrier roll 82 amplifies the measurement signal (i.e. COF change with and without the condensed fountain solution film). However, it may also require a lower relative velocity between the carrier roll 82 and imaging member 24 in order to achieve a uniform fountain solution film or layer 90 thickness.

Figure 4B:
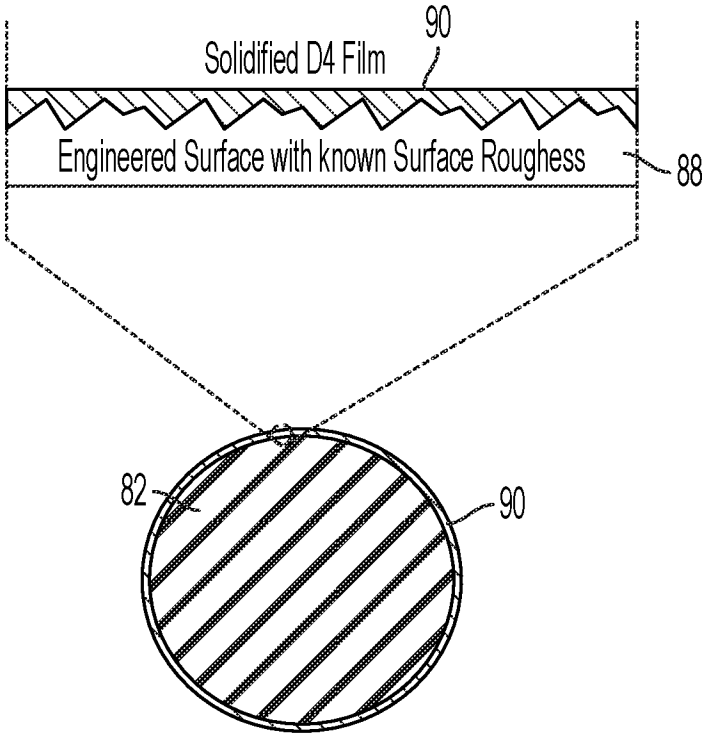
FIG. 4B is a front view of the carrier roll of FIG. 4A covered with fountain solution (FS)
Figure 4A:
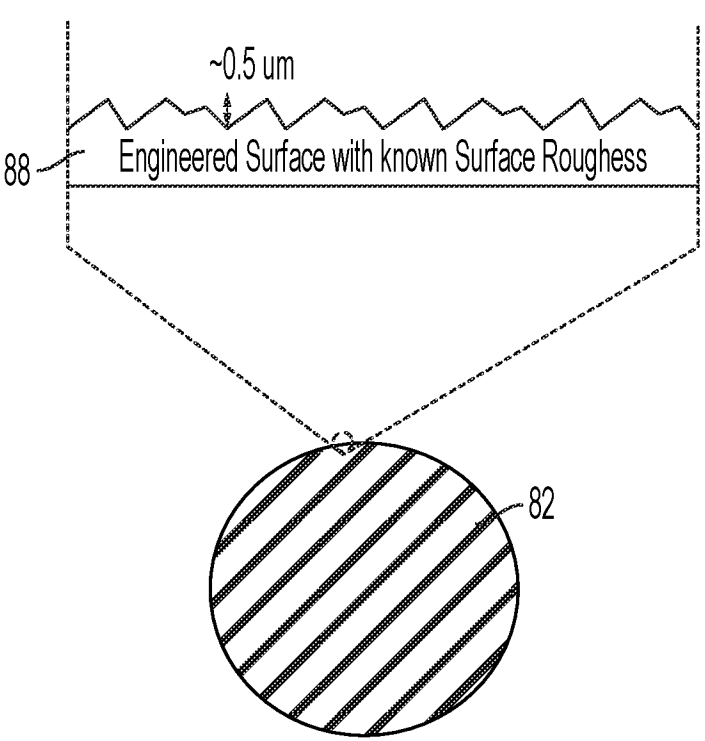
FIG. 4A is a front view of a carrier roll in accordance with examples.

FIGS. 4A and 4B illustrate an exemplary engineered surface 88 of the carrier roll 82 before and after a fountain solution 98 transfer. In this example the surface 88 may be engineered to have a surface roughness of about 0.5 μm, which corresponds to about 220 grit wet/dry sandpaper. The carrier roll 82 may have a hard durable surface (e.g., aluminum, stainless steel). The carrier roll may be chilled or maintained at a temperature near or below the melting point of the fountain solution so the re-condensed fountain solution stays on the carrier roll surface 88 in liquid (e.g., room temperature to about 18° C.) or solid (e.g., less than about 17° C.) form. In examples, fountain solution COF measurements taken with the fountain solution solid may minimize undesired evaporation of the fountain solution from the carrier roll.

Figure 5:
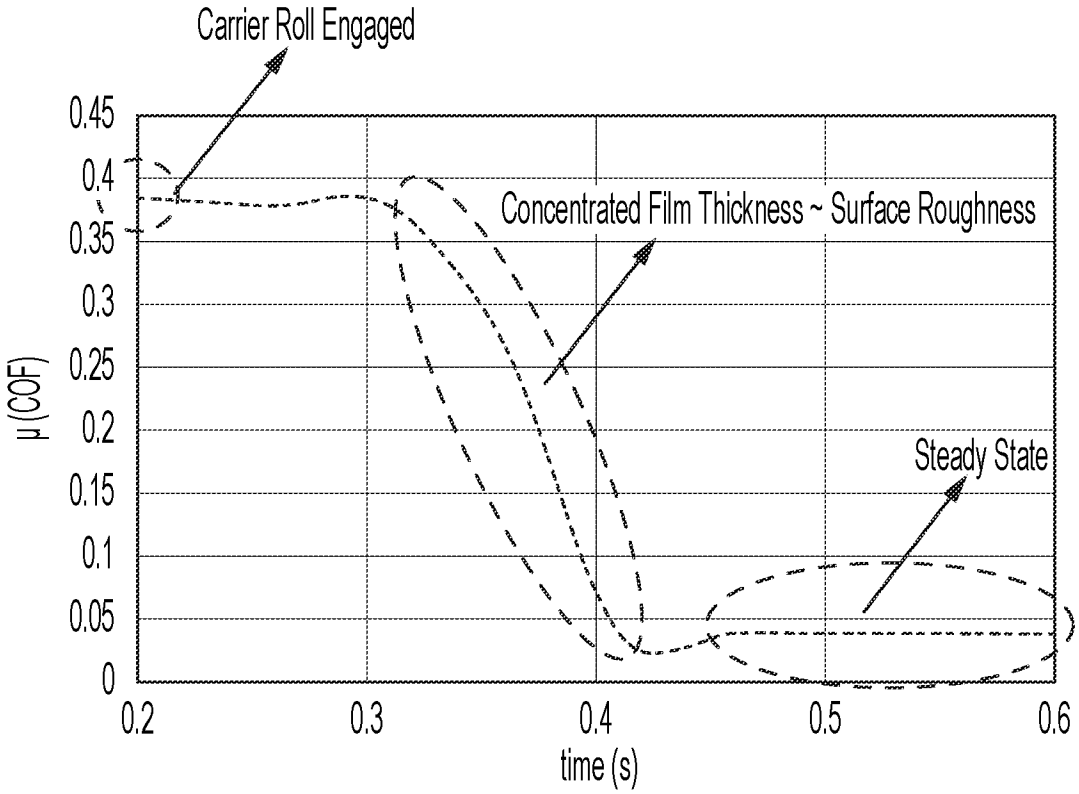
FIG. 5 is a graph illustrating exemplary coefficient of friction (COF) variation with time on a carrier roll collecting re-condensed fountain solution.

An exemplary COF measurement of the carrier roll surface 88 may yield a curve as noted in FIG. 5, which depicts COF variation with time on the carrier roll, for example as the roll collects fountain solution transferred from an imaging member surface. The layer of fountain solution is a dampening fluid film that may act as a lubricant reducing the carrier roll surface COF as the layer thickens until the layer reaches a thickness sufficient for the COF to reach a steady state.

The controller may estimate the thickness of the dispensed fountain solution fluid layer on the imaging member based on the measured COF of the carrier roll surface 88, including step changes in the COF indicating the transferred fountain solution has filled pits in the roughened carrier roll surface (FIG. 4B). In examples the carrier roll surface may have a roughness of about 0.5 μm and a relative surface velocity to the imaging member surface velocity of 0.1. A step change in the COF may take place based on the carrier roll surface roughness, for example, at an imaging member surface, fountain solution thickness=0.1*0.5 μm=0.05 μm or 50 nm, which is an exemplary desired imaging member fountain solution layer thickness for printing. Thus the controller may determine fountain solution thickness based on the time needed for the COF to reach steady state (FIG. 5). This determination accounts for the transition period where the fountain solution fills up the carrier roll surface landscape voids first and then the surface peaks. Therefore, a continuous measurement of COF may indicate when the film has reached appropriate thickness.

In examples, the carrier roll surface 88 may be maintained at or below the freezing temperature of the fountain solution (e.g., about 17° C.) and solidify the transferred fountain solution for improved COF measurement. In such examples, once the measurement is complete, the temperature of the carrier roll surface may be restored to ambient conditions so the fountain solution can melt and be cleaned off. The carrier roll 82 may be disengaged from its proximity to the imaging member to aid in restoring its temperature and cleaning its surface, for example as discussed in greater detail below.

FIG. 6 depicts the measuring system 80 including an approach to clean the carrier roll surface 88. In examples, after completion of COF measurements as discussed herein, carrier roll surface 88 may be cleaned of condensed transferred fountain solution to allow for subsequent COF measurements or series of measurements. While not being limited to a particular theory, the carrier roll surface may be cleaned by re-vaporizing the measured re-condensed fountain solution layer 90 from surface 88. In this example, the re-condensed fountain solution layer 90 may be heated by a heat source, which may be heat source 84 or an equivalent heat source, and evaporated from the carrier roll surface 88. The displacement unit 98 discussed above may connect to the carrier roll 82 and shift the carrier roll away from the imaging member surface 26 for the cleaning, and shift the cleaned carrier roll towards the imaging member surface. Once clean, the carrier roll 82 may be ready for a subsequent fountain solution transfer and measurement.

Referring back to FIG. 5, it should be noted that the exemplary COF measurements on the engineered carrier roll surface 88 may provide a steep signal pertaining to a lower limit of when the fountain solution film on the carrier roll overcomes surface roughness. As the fountain solution continues to accumulate on the carrier roll 82, measurements reach a steady state where they do not experience any further change. In examples, the carrier roll may have an engineered surface of varying surface roughness, such as along the cross process direction of carrier roll surface rotation. This allows an even more highly accurate bracketed measurement of the film thickness. As fountain solution builds up on the carrier roll surface 88, COF measurements by the sensor 58 would show step changes triggered in an order of incremental surface roughness as the thickening fountain solution layer overcomes the incremental surface roughness.

Figure 7B:
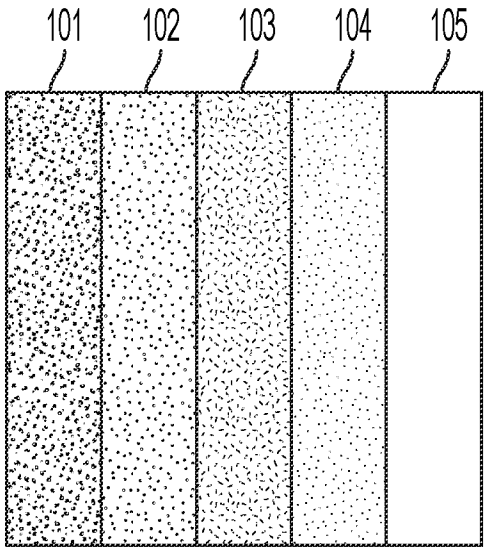
FIG. 7B is a side view of the carrier roll of FIG. 7A.
Figure 7A:
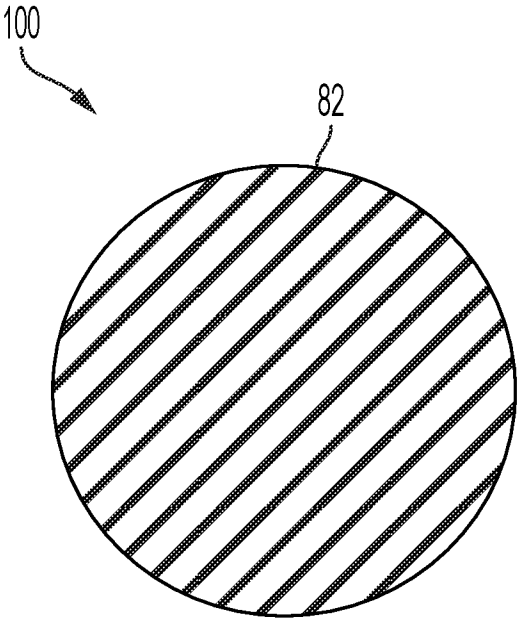
FIG. 7A is a front view of an exemplary carrier roll.

FIGS. 7A and 7B depict an example 100 of a carrier roll 82 in front and side views, respectfully. While not being limited to a particular roughness, the exemplary carrier roll 82 in FIG. 7B has different surface roughness decreasing from Sections 101-105, such that Section 101 has a rougher surface than Section 102, which has a rougher surface than Section 103, etc. COF measurements of the carrier roll surface 88 during fountain solution transfer accumulation from the imaging member surface 26 would show step changes in the order of incremental surface roughness (i.e. Section 105 followed by Section 104, all the way down to Section 101).

Figure 8:
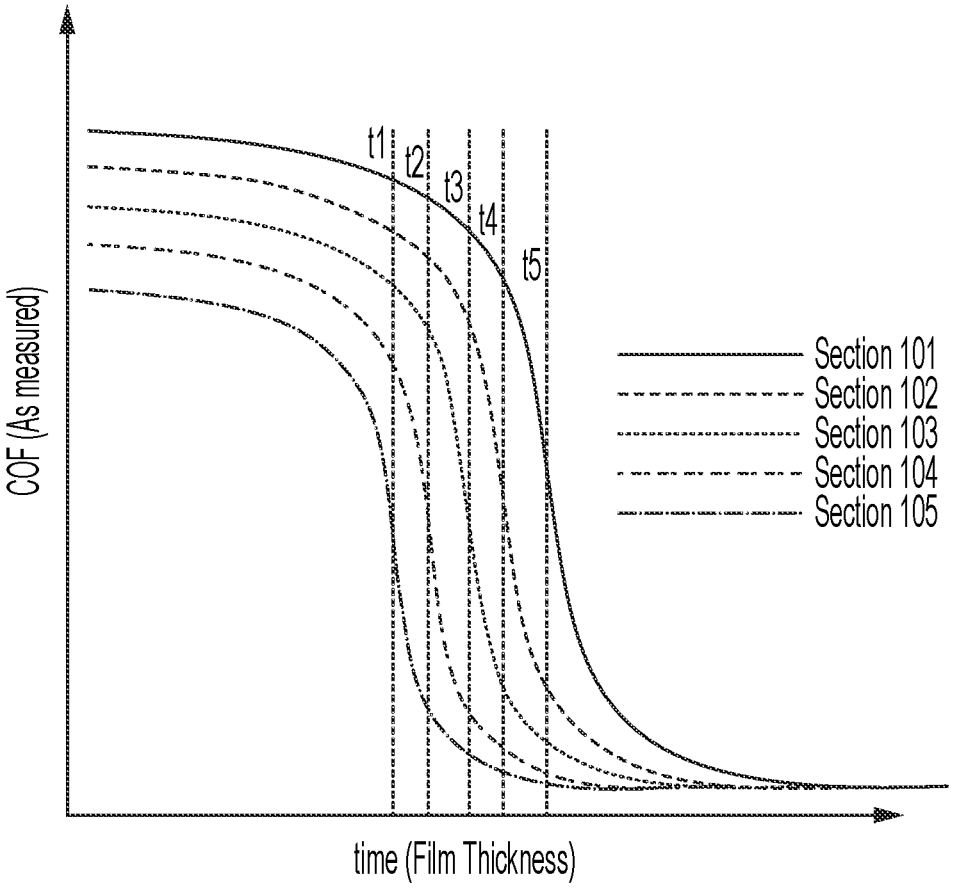
FIG. 8 is a graph illustrating exemplary COF transition curves for a carrier roll with varying surface roughness.

FIG. 8 illustrates exemplary COF step changes for fountain solution accumulation on a carrier roll having different roughness Sections 101-105. As can be seen, the COF is increased as the surface roughens. Yet each section reaches its step change identified by the steepened slope as more fountain solution is transferred to the carrier roll surface over time. Thus in examples with a carrier roll 82 having sections of different roughnesses, the controller 60 can correlate step changes to carrier roll 82 fountain solution layer thickness, and can estimate the thickness of fountain solution layer 32 on the imaging member surface 26 based on rotational surface speed differences between the imaging member 24 and the carrier roll. Under an example with Sections 101-105 having respective surface roughnesses of about 0.6 μm, 0.5 μm, 0.4 μm, 0.3 μm and 0.2 μm, the controller 60 may modify the fountain solution applicator dispense rate according to step changes in COF measurements across the surface sections, for example to keep the measurements where Section 102 is in its steep step for a carrier roll rotational surface speed of about one-tenth the rotational surface speed of the imaging member surface.

It is understood that the approaches discussed herein by example to modify fountain solution thickness do not require a determination of the actual fountain solution layer thickness. Measured COF to actual fountain solution layer thickness may be correlated such that a desired fountain solution thickness (e.g., between about 0.01 μm and about 1.0 μm, less than 5 μm, about 35-70 nm) has a corresponding carrier roll surface roughness and COF step change that the controller 60 may compare to a measured COF or step change for known surface roughnesses thereof over time and determine if the fountain solution applicator 14 needs to increase, decrease or maintain the fountain solution dispense rate. The COF measurement results may thus be used over time to monitor fountain solution layer 32 thickness, and if desired, may allow the image forming device 10 to control fountain solution layer thickness by modifying the fountain solution dispense rate onto the imaging member 24 as needed to arrive at or maintain the desired fountain solution thickness. Fountain solution layer 32 thickness quality control monitoring may be applied automatically during the printing process with periodic sampling during a single printing or multiple printings. This way fountain solution flow rate adjustment can be made "on the fly", reducing or eliminating the production of printings having undesired lessened quality.

In examples, the controller 60 may compare the measured COF to a target COF that may correspond to the desired fountain solution thickness for a known surface roughness. In this instance, fountain solution thickness may not need to be determined from the measured COF as COF values per surface roughness may generally correspond to a range of fountain solution thickness such that the controller 60 may compare the measured COF to a target COF value and adjust fountain solution flow based on the comparison. It is understood that the measured COF and target COF may be determined as total COF of the fountain solution layer on the carrier roll surface 88 or as delta COF on the measured surface dry versus wetted with the condensed fountain solution on the carrier roll surface.

In other examples, the controller 60 may estimate a thickness of the transferred fountain solution based on the measured COF and modify fountain solution dispense rate based on the estimated thickness of the transferred fountain solution layer on the carrier roll surface or the initially dispensed fountain solution layer on the imaging member surface. For example, the controller 60 may estimate or determine fountain solution thickness via a lookup table or database stored in data storage device 124 (FIG. 9) of the controller, with the lookup table/database providing estimates of fountain solution thickness based on measured COF for known surface roughnesses. The controller 60 may then compare the estimated thickness of the dispensed fountain solution fluid layer with a target thickness (e.g., between about 0.01 μm and about 1.0 μm, less than 5 μm, about 30-70 nm), and adjust the fountain solution dispense rate as needed based on the comparison.

The controller 60 may thus modify or direct modification of the fountain solution dispense rate based on the COF sensor 86 measurement, or based on the fountain solution layer thickness determined or estimated in association with the COF measurement. The controller 60 may determine the fountain solution thickness by correlating COF measurements of the re-condensed fountain solution layer 90 on the carrier roller surface 88 to fountain solution layer 32 thickness. The controller 60 may access a lookup table (LUT) in data storage device 124 (FIG. 9) for correlation between COF/roughness and fountain solution thickness. Further, the controller 60 may access the LUT to determine an amount of modification of the fountain solution flow rate needed to reach or maintain the desired fountain solution layer thickness.

While measurement of the fountain solution thickness is not required for the print process discussed herein including modifying fountain solution dispense/deposition rate in real time, the inventors found it is highly desirable to measure COF of a wetted carrier roll surface that directly correlates to the fountain solution thickness on the imaging member 24. To this end, the digital image forming device 10 may control fountain solution thickness on the imaging member surface 26 regardless of knowing the actual thickness. It is also understood that the COF measurement and fountain solution dispense rate modification may occur at different times and is not limited to occurrence during a print job by the digital image forming device 10. In other words, COF measurement and fountain solution dispense rate modification may occur during a print job, between print jobs, or even when no print job is scheduled.

Figure 9:
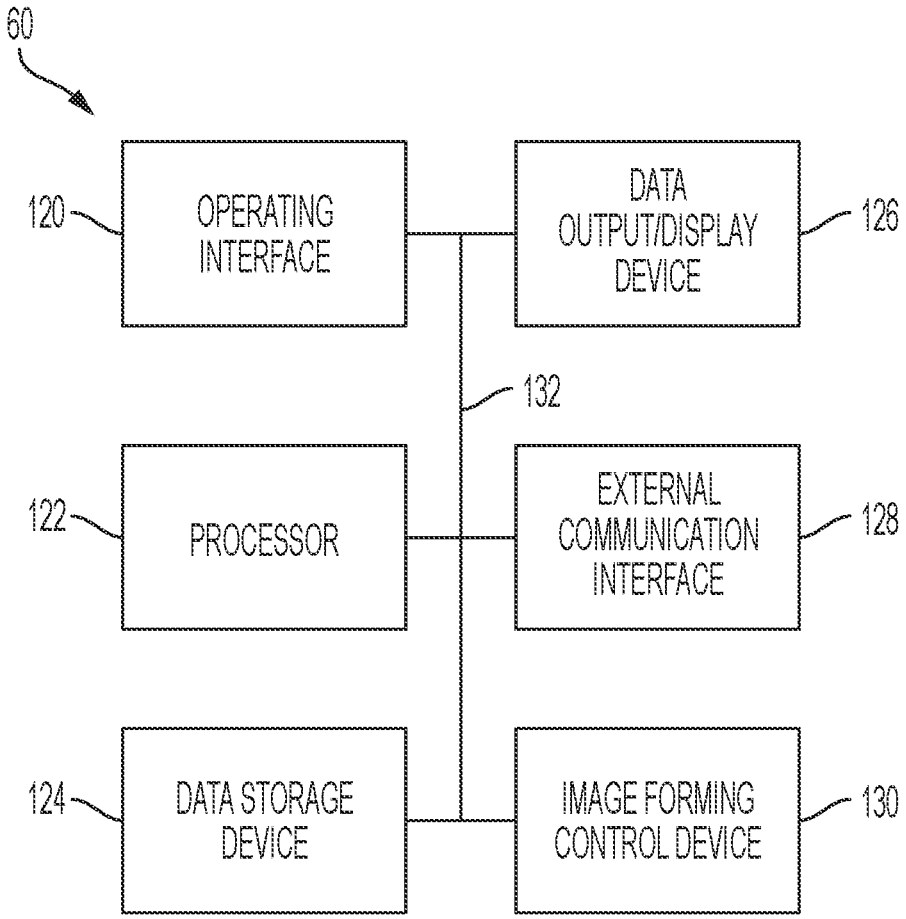
FIG. 9 is a block diagram of a controller with a processor for executing instructions to automatically control devices in a digital image forming device.

FIG. 9 illustrates a block diagram of the controller 60 for executing instructions to automatically control the digital image forming device 10 and components thereof. The exemplary controller 60 may provide input to or be a component of the digital image forming device for executing the image formation method including controlling fountain solution thickness in a system such as that depicted in FIGS. 1-4 and 6, and described in greater detail below.

The exemplary controller 60 may include an operating interface 120 by which a user may communicate with the exemplary control system. The operating interface 120 may be a locally-accessible user interface associated with the digital image forming device 10. The operating interface 120 may be configured as one or more conventional mechanism common to controllers and/or computing devices that may permit a user to input information to the exemplary controller 60. The operating interface 120 may include, for example, a conventional keyboard, a touchscreen with "soft" buttons or with various components for use with a compatible stylus, a microphone by which a user may provide oral commands to the exemplary controller 60 to be "translated" by a voice recognition program, or other like device by which a user may communicate specific operating instructions to the exemplary controller. The operating interface 120 may be a part or a function of a graphical user interface (GUI) mounted on, integral to, or associated with, the digital image forming device 10 with which the exemplary controller 60 is associated.

The exemplary controller 60 may include one or more local processors 122 for individually operating the exemplary controller 60 and for carrying into effect control and operating functions for image formation onto a print substrate 34, including rendering digital images, measuring carrier roll surface 88 COF, determining fountain solution layer thickness on the carrier roll and/or determining fountain solution on the imaging member surface 26, and/or to determine image forming device real-time image forming modifications for subsequent printings. For example, in real-time during the printing of a print job, based on the measured COF of the wetted carrier roll surface, processors 122 may adjust image forming (e.g., fountain solution deposition flow rate) to reach or maintain a preferred fountain solution thickness on the imaging member surface for subsequent (e.g., next) printings of the print job with the digital image forming device 10 with which the exemplary controller may be associated. Processor(s) 122 may include at least one conventional processor or microprocessor that interprets and executes instructions to direct specific functioning of the exemplary controller 60, and control adjustments of the image forming process with the exemplary controller.

The exemplary controller 60 may include one or more data storage devices 124. Such data storage device(s) 124 may be used to store data or operating programs to be used by the exemplary controller 60, and specifically the processor(s) 122. Data storage device(s) 124 may be used to store information regarding, for example, digital image information, printed image response data, fountain solution thickness corresponding to COF, a target fountain solution thickness and/or corresponding target COF, and other fountain solution deposition information with which the digital image forming device 10 is associated. Stored fountain solution COF and thickness data may be devolved into data to generate a recurring, continuous or closed loop feedback fountain solution deposition rate modification in the manner generally described by examples herein.

The data storage device(s) 124 may include a random access memory (RAM) or another type of dynamic storage device that is capable of storing updatable database information, and for separately storing instructions for execution of image correction operations by, for example, processor(s) 122. Data storage device(s) 124 may also include a read-only memory (ROM), which may include a conventional ROM device or another type of static storage device that stores static information and instructions for processor(s) 122. Further, the data storage device(s) 124 may be integral to the exemplary controller 60, or may be provided external to, and in wired or wireless communication with, the exemplary controller 60, including as cloud-based data storage components.

The data storage device(s) 124 may include non-transitory machine-readable storage medium used to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 60 and that causes the digital image forming device 10 to perform any one or more of the methodologies of the present invention. The term "machine-readable storage medium" shall accordingly be taken to include, but not be limited to, solid-state memories, and optical and magnetic media.

The exemplary controller 60 may include at least one data output/display device 126, which may be configured as one or more conventional mechanisms that output information to a user, including, but not limited to, a display screen on a GUI of the digital image forming device 10 or associated image forming device with which the exemplary controller 60 may be associated. The data output/display device 126 may be used to indicate to a user a status of the digital image forming device 10 with which the exemplary controller 60 may be associated including an operation of one or more individually controlled components at one or more of a plurality of separate image processing stations or subsystems associated with the image forming device.

The exemplary controller 60 may include one or more separate external communication interfaces 128 by which the exemplary controller 60 may communicate with components that may be external to the exemplary control system such as the measuring system 80 that can monitor fountain solution layer 32, 90 COF data and related thickness. At least one of the external communication interfaces 128 may be configured as an input port to support connecting an external CAD/CAM device storing modeling information for execution of the control functions in the image formation and correction operations. Any suitable data connection to provide wired or wireless communication between the exemplary controller 60 and external and/or associated components is contemplated to be encompassed by the depicted external communication interface 128.

The exemplary controller 60 may include an image forming control device 130 that may be used to control an image correction process including fountain solution deposition rate control and modification to render images on imaging member surface 26 having a desired fountain solution thickness. For example, the image forming control device 130 may render digital images on the reimageable surface 26 having a desired fountain solution thickness from fountain solution flow adjusted automatically in real-time based on fountain solution COF measurements between prior printings of the same print job. The image forming control device 130 may operate as a part or a function of the processor 122 coupled to one or more of the data storage devices 124 and the digital image forming device 10 (e.g., optical patterning subsystem 16, inking apparatus 18, dampening station 12), or may operate as a separate stand-alone component module or circuit in the exemplary controller 60.

All of the various components of the exemplary controller 60, as depicted in FIG. 9, may be connected internally, and to the digital image forming device 10, associated image forming apparatuses downstream the image forming device and/or components thereof, by one or more data/control busses 132. These data/control busses 132 may provide wired or wireless communication between the various components of the image forming device 10 and any associated image forming apparatus, whether all of those components are housed integrally in, or are otherwise external and connected to image forming devices with which the exemplary controller 60 may be associated.

It should be appreciated that, although depicted in FIG. 9 as an integral unit, the various disclosed elements of the exemplary controller 60 may be arranged in any combination of subsystems as individual components or combinations of components, integral to a single unit, or external to, and in wired or wireless communication with the single unit of the exemplary control system. In other words, no specific configuration as an integral unit or as a support unit is to be implied by the depiction in FIG. 9. Further, although depicted as individual units for ease of understanding of the details provided in this disclosure regarding the exemplary controller 60, it should be understood that the described functions of any of the individually-depicted components, and particularly each of the depicted control devices, may be undertaken, for example, by one or more processors 122 connected to, and in communication with, one or more data storage device(s) 124.

Figure 10:
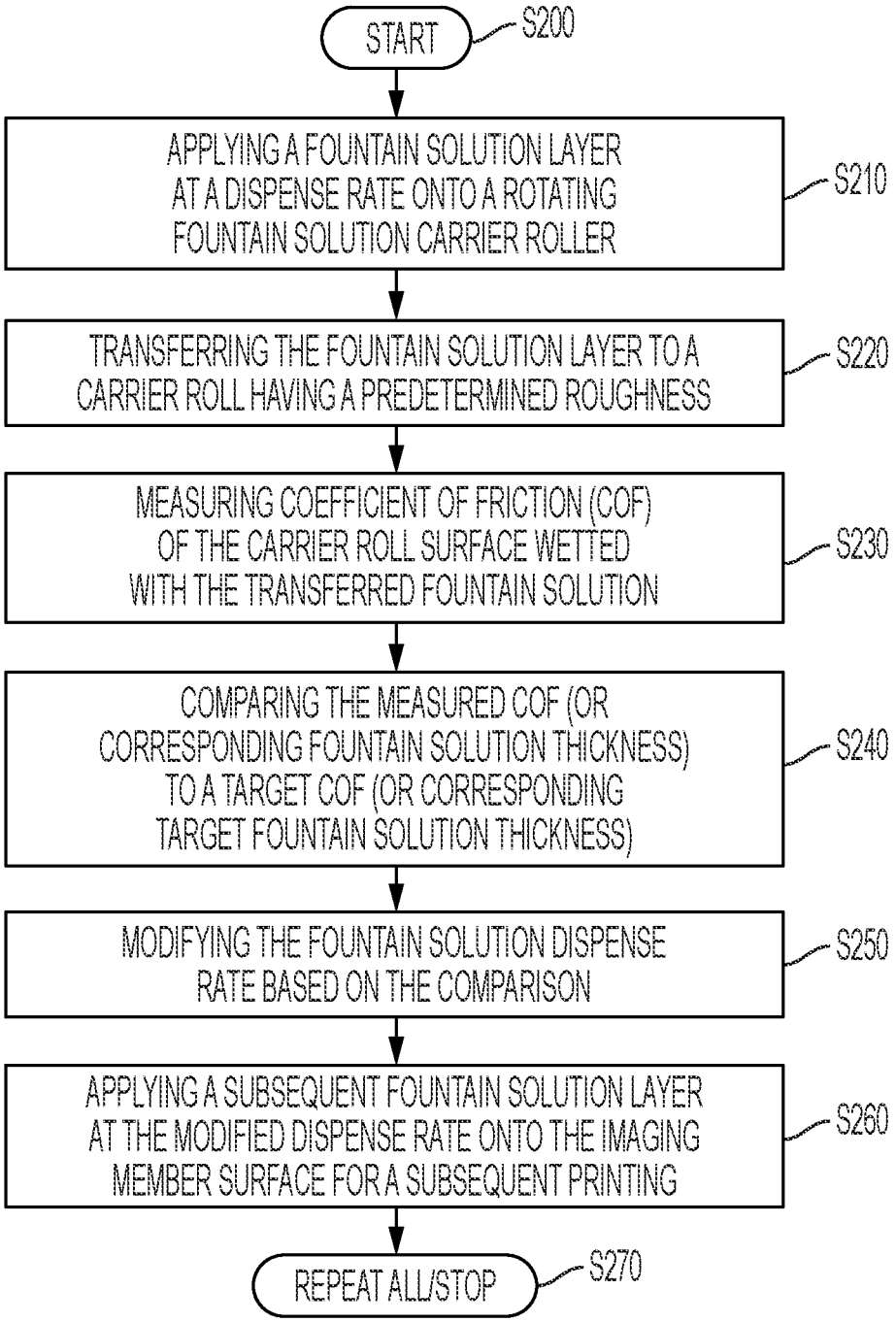
FIG. 10 is a flowchart depicting an operation of an exemplary image forming device.

The disclosed embodiments may include an exemplary method for controlling fountain solution thickness on an imaging member surface of a rotating imaging member in a digital image forming device 10. FIG. 10 illustrates a flowchart of such an exemplary method. As shown in FIG. 10, operation of the method commences at Step S200 and proceeds to Step S210.

At Step S210, a fountain solution applicator 14 applies a fountain solution fluid layer 32 at a dispense rate onto a rotating fountain solution carrier roller, which may be, for example an imaging member 24 or intermediate roller 30 surface. Operation of the method proceeds to Step S220, where the fountain solution fluid layer is transferred from the rotating imaging member 24 onto an adjacent carrier roll 82 having a surface 88 with a COF that varies as a function of fountain solution film thickness to allow the transferred fountain solution to wet the carrier roll surface and alter the COF to a wetted COF. In examples, the fountain solution may be transferred by heating the fountain solution to a vapor that re-condenses on the carrier roll. In examples, the carrier roll surface may be maintained at a temperature that solidifies the re-condensed fountain solution.

Next, at Step S230, the wetted COF of the wetted carrier roll surface is measured. The carrier roll surface may have an engineered surface with a known roughness and COF that changes according to the roughness and thickness of the re-condensed fountain solution on the carrier roll surface. The measured COF over time may indicate a step change indicating that the re-condensed fountain solution layer is sufficiently thick to cover or fill in the roughness of the carrier roll engineered surface.

Operation proceeds to Step S240, where the controller 60 compares the measured COF (or corresponding fountain solution thickness on either the carrier roll or the imaging member) to a target COF (or corresponding target fountain solution thickness on either the carrier roll or the imaging member). In examples the target COF corresponds to the target fountain solution thickness on the imaging member (e.g., between about 0.01 μm and about 1.0 μm, less than 5 μm, about 30-150 nm) desired for optimal printing as understood by a skilled artisan. If the measured COF of the wetted engineered carrier roll surface indicates the corresponding fountain solution thickness is higher than the target fountain solution thickness, then too much fountain solution is being applied to the imaging member surface, and the laser may not be able to sufficiently boil/evaporate/ablate the fountain solution layer to create a clear latent image on the blanket. If the measured COF of the wetted engineered carrier roll surface indicates the corresponding fountain solution thickness is lower than the target fountain solution thickness, then too little fountain solution is being applied to the imaging member surface, and subsequently applied ink will not be sufficiently rejected in non-imaged regions leading to overly thick ink images with too much background. Information regarding corresponding COF per carrier roll roughness and fountain solution thickness, as well as target COF per carrier roll roughness and fountain solution thickness information may be stored in data storage device 124 as depicted in FIG. 9 or as a lookup table for access to the controller 60.

Operation of the method proceeds to Step S250, where the fountain solution dispense rate is modified as needed based on the measured COF, including comparison thereof, for subsequent printing using the modified fountain solution dispense rate. The fountain solution dispense rate may be modified by the digital image forming device 10 via instruction from the controller 60. For example, if the measured COF of the wetted engineered carrier roll surface indicates the corresponding fountain solution thickness is higher than the target fountain solution thickness, then the fountain solution dispense rate is lowered accordingly. Further, if the measured COF of the wetted engineered carrier roll surface indicates the corresponding fountain solution thickness is lower than the target fountain solution thickness, then the fountain solution dispense rate is increased accordingly.

Operation of the method proceeds to Step S260, where the fountain solution applicator 14 applies a subsequent fountain solution fluid layer 32 at the modified dispense rate onto the imaging member surface 26 for a subsequent printing. Operation may cease at Step S270, or may continue by repeating back to Step S220 for a subsequent fountain solution transfer to the carrier roll and COF measurements of the fountain solution initially dispensed onto the imaging member at the modified dispense rate.

Figure 11:
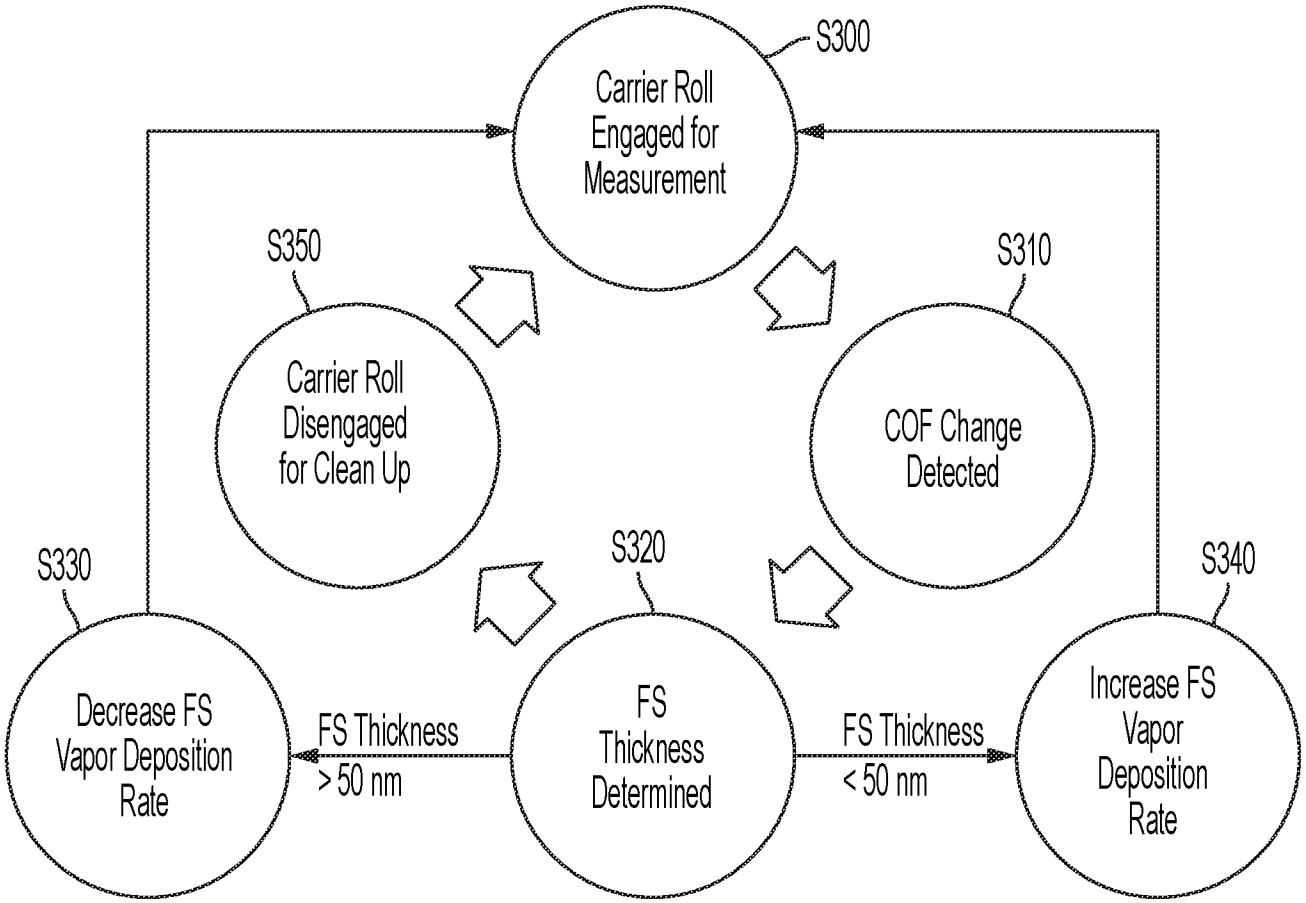
FIG. 11 is a flowchart depicting a closed loop fountain solution thickness control operation of an exemplary image forming device.

FIG. 11 is a flowchart of an exemplary method for controlling fountain solution thickness on an imaging member surface of a rotating imaging member in a digital image forming device 10. The flowchart summarizes a closed loop approach to ensure automatic control of the fountain solution thickness on the imaging member surface 26, with the degree of control associated with the frequency of the measurements. In this example, the target fountain solution layer 32 thickness on the imaging member is 50 nm. The scope is not limited to a particular target thickness, as the target thickness may be predetermined or set to other thicknesses appropriate for digital printing with the system 10.

As shown in FIG. 11, operation of the method commences at Step S300, where a COF sensor is engaged against a carrier roll surface 88 for COF measurement. The carrier roll 82 is positioned adjacent the imaging member 24, which has a layer 32 of fountain solution dispensed thereon by a fountain solution applicator 14 at a dispense rate. The dispensed fountain solution is transferred to the carrier roll surface 88, for example, by vaporization off of the imaging member surface and re-condensation on the carrier roll surface. The re-condensed fountain solution may wet and be solidified (e.g., frozen) on the carrier roll surface based on the temperature of the carrier roll. Operation proceeds to Step S310, where COF measurements of the wetted carrier roll surface 88 are taken over time looking for changes and step changes in the COF as the re-condensed fountain solution thickens on the surface.

Upon detection of such changes and step changes, operation proceeds to Step S320 where the originally dispensed fountain solution layer 32 thickness is determined based on the re-condensed fountain solution thickness. As discussed above, the fountain solution layer 32 thickness may be determined based on known factors such as the roughness of the carrier roll surface 88, the rotational speed of the carrier roll surface in relation to the imaging member surface rotational speed, and the COF measurements including measurements showing step changes and steady state.

Operation proceeds based on the fountain solution layer 32 thickness determinations in comparison to the target thickness. If the fountain solution layer 32 thickness is greater than the target thickness (e.g., 50 nm), then operation proceeds to Step S330, where the vapor deposition rate is decreased to thin subsequent fountain solution layers closer to the target thickness. If the fountain solution layer 32 thickness is less than the target thickness, then operation proceeds to Step S340, where the vapor deposition rate is increased to thicken subsequent fountain solution layers closer to the target thickness. If the fountain solution layer 32 thickness is equal to the target thickness, then the vapor deposition rate is not changed.

Regardless of the fountain solution layer 32 thickness determination at Step S320, operation also proceeds to Step S350, where the carrier roll 82 may be disengaged from the COF sensor 86 and moved from the imaging member 24 as needed for cleanup (e.g., by vaporization of the re-condensed fountain solution) and reuse for a subsequent COF measurement. Operation returns to S300 for the subsequent measurement.

The exemplary depicted sequence of executable method steps represents examples of a corresponding sequence of acts for implementing the functions described in the respective steps. The exemplary depicted steps may be executed in any reasonable order to carry into effect the benefits of the disclosed approaches. No particular order to the disclosed steps of the methods is necessarily implied by the depiction in FIGS. 10 and 11, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method of controlling fountain solution thickness on an imaging member surface of a rotating imaging member in an image forming device, comprising:

(a) transferring fountain solution from a fountain solution layer dispensed at a fountain solution dispense rate onto the rotating imaging member onto a carrier roll having a surface with a coefficient of friction that varies as a function of fountain solution layer thickness to allow the transferred fountain solution to wet the carrier roll surface and alter the coefficient of friction to a wetted coefficient of friction;

(b) measuring the wetted coefficient of friction of the wetted carrier roll surface as a measured coefficient of friction;

(c) modifying the fountain solution dispense rate to a modified fountain solution dispense rate based on the measured coefficient of friction; and (d) applying a subsequent fountain solution layer at the modified fountain solution dispense rate onto the imaging member surface for an image forming operation thereon.

2. The method of claim 1, further comprising, before Step (a), dispensing the fountain solution from a fountain solution applicator at the fountain solution dispense rate onto the rotating imaging member to form the fountain solution layer.

3. The method of claim 1, further comprising, before Step (a) positioning the carrier roll adjacent to and spatially separate from the imaging member.

4. The method of claim 3, further comprising, after step (b), withdrawing the carrier roll away from the imaging member and removing the transferred fountain solution from the carrier roll.

5. The method of claim 1, further comprising, in Step (a), transferring the fountain solution as fountain solution vapor from the fountain solution layer dispensed onto the rotating imaging member.

6. The method of claim 5, further comprising, between Step (a) and Step (b), solidifying the transferred fountain solution on the carrier roll, and after Step (b), vaporizing the solidified fountain solution.

7. The method of claim 1, further comprising, after Step (b), comparing the measured coefficient of friction of the wetted carrier roll surface to a target coefficient of friction, the target coefficient of friction corresponding to a predetermined fountain solution layer thickness on the rotating imaging member, and Step (c) includes modifying the fountain solution dispense rate based on the comparison.

8. The method of claim 1, further comprising, after Step (b), estimating a thickness of the fountain solution layer dispensed onto the imaging member based on the measured coefficient of friction of the wetted carrier roll surface, and Step (c) includes modifying the fountain solution dispense rate based on the estimated thickness of the fountain solution layer.

9. The method of claim 8, further comprising comparing the estimated thickness of the fountain solution layer dispensed onto the imaging member with a target thickness, and Step (c) further includes modifying the fountain solution dispense rate based on the comparison between the estimated thickness of the fountain solution layer and the target thickness.

10. The method of claim 1, further comprising before Step (b) moving a coefficient of friction sensor into contact with the carrier roll, during Step (b) measuring the wetted coefficient of friction of the wetted carrier roll surface with the coefficient of friction sensor, and after Step (b) moving the coefficient of friction sensor away from contact with the carrier roll.

11. The method of claim 1, further comprising, during Step (a), rotating the carrier roll at a rotational speed slower than a rotational speed of the rotating imaging member, with the transferred fountain solution forming a layer on the carrier roll thicker than the dispensed fountain solution layer.

12. The method of claim 1, further comprising, after Step (a), solidifying the transferred fountain solution on the carrier roll.

13. A method of controlling fountain solution thickness on an imaging member surface of a rotating imaging member in an image forming device, the image forming device printing a current image onto a print substrate, the printing including applying a fountain solution layer at a fountain solution dispense rate onto the imaging member surface, vaporizing in an image wise fashion a portion of the fountain solution layer on the imaging member surface to form a latent image, applying ink onto the latent image, and transferring the applied ink to the print substrate, the method of controlling fountain solution thickness comprising:

(a) transferring fountain solution from the fountain solution layer dispensed at the fountain solution dispense rate onto the rotating imaging member onto a carrier roll having a surface with a coefficient of friction that varies as a function of fountain solution layer thickness to allow the transferred fountain solution to wet the carrier roll surface and alter the coefficient of friction to a wetted coefficient of friction;

(b) measuring the wetted coefficient of friction of the wetted carrier roll surface as a measured coefficient of friction; and (c) modifying the fountain solution dispense rate to a modified fountain solution dispense rate based on the measured coefficient of friction for a subsequent printing of a subsequent image by the image forming device using the modified fountain solution dispense rate.

14. An image forming device controlling fountain solution thickness on an imaging member surface of a rotating imaging member, comprising:

a carrier roll having a surface with a coefficient of friction that varies as a function of fountain solution layer thickness;

a heat source configured to evaporate fountain solution from a fountain solution layer dispensed onto the rotating imaging member at a dispense rate for transfer onto the carrier roll, the transferred fountain solution wetting the carrier roll surface via condensation thereon and altering the coefficient of friction to a wetted coefficient of friction;

a sensor including a sensor head adjacent the carrier roller and in contact with the transferred fountain solution, the sensor configured to measure the wetted coefficient of friction; and a controller in communication with the sensor and a fountain solution applicator to modify the dispense rate based on the measured wetted coefficient of friction for a subsequent dispense of a subsequent fountain solution layer at the modified fountain solution dispense rate onto the imaging member surface for an image forming operation thereon.

15. The image forming device of claim 14, wherein the carrier roll surface is engineered to have a root-mean-squared (RMS) surface roughness greater than 0.2 μm.

16. The image forming device of claim 15, wherein the carrier roll surface includes a plurality of engineered surface sections, wherein one of the plurality of engineered surface sections is engineered to have a root-mean-squared (RMS) surface roughness different than another one of the plurality of engineered surface sections.

17. The image forming device of claim 14, further comprising the subsequent fountain solution layer, wherein the carrier roll surface is engineered to have a root-mean-squared (RMS) surface roughness greater than a thickness of the subsequent fountain solution layer.

18. The image forming device of claim 14, wherein the heat source includes an LED bar.

19. The image forming device of claim 14, wherein the carrier roll surface is chilled to a temperature below a freezing temperature of the fountain solution to solidify the transferred fountain solution.

20. The image forming device of claim 14, the fountain solution applicator configured to dispense the fountain solution layer onto the rotating imaging member at the dispense rate and to dispense the subsequent fountain solution layer at the modified fountain solution dispense rate onto the rotating imaging member for the image forming operation thereon.

* * * * *